US009866935B2

(12) United States Patent
Jiang et al.

(10) Patent No.: US 9,866,935 B2
(45) Date of Patent: Jan. 9, 2018

(54) WOOFER SPEAKER AND THE REAR SOUND CAVITY FORMING METHOD THEREOF

(71) Applicant: GOERTEK INC., WeiFang (CN)

(72) Inventors: Bin Jiang, WeiFang (CN); Chao Jiang, WeiFang (CN); Jianbin Yang, WeiFang (CN)

(73) Assignee: GOERTEK INC., Weifang (CN)

( * ) Notice: Subject to any disclaimer, the term of this patent is extended or adjusted under 35 U.S.C. 154(b) by 73 days.

(21) Appl. No.: 14/894,308

(22) PCT Filed: May 31, 2013

(86) PCT No.: PCT/CN2013/076600
§ 371 (c)(1),
(2) Date: Nov. 25, 2015

(87) PCT Pub. No.: WO2014/190556
PCT Pub. Date: Dec. 4, 2014

(65) Prior Publication Data

US 2016/0127824 A1 May 5, 2016

(30) Foreign Application Priority Data

May 29, 2013 (CN) ..... 2013 1 0207754

(51) Int. Cl.
*H04R 1/02* (2006.01)
*H04R 9/02* (2006.01)
(Continued)

(52) U.S. Cl.
CPC ..... *H04R 1/025* (2013.01); *H04R 1/323* (2013.01); *H04R 9/02* (2013.01); *H04R 1/2803* (2013.01);
(Continued)

(58) Field of Classification Search
CPC ..... H04R 1/025; H04R 1/026; H04R 1/028; H04R 1/2888; H04R 2201/021; H04R 2499/15
See application file for complete search history.

(56) References Cited

U.S. PATENT DOCUMENTS 4,072,829 A * 2/1978 Ogihara ..... H04R 1/025 381/392
6,876,743 B2 * 4/2005 Asahina ..... H04M 1/03 181/199
(Continued)

FOREIGN PATENT DOCUMENTS

CN 201499293 U 6/2010
CN 202551337 U 11/2012
(Continued)

OTHER PUBLICATIONS

Office Action from Korean Patent Office for Application No. 10-2015-7036914, dated Sep. 27, 2016.
(Continued)

*Primary Examiner* — Matthew Eason

(57) ABSTRACT

A woofer speaker is provided, comprising a woofer speaker unit, a first sealing pad, a second sealing pad and a housing. The first sealing pad is fixed closely with the outer edge of the housing; the woofer speaker unit is fixed and sealed within the housing by the first sealing pad, and the second sealing pad is located between the woofer speaker unit and the housing; a sound hole is provided on the housing, and the shape and size of the sound hole correspond to those of the woofer speaker; and the terminal installation plane is the rear cover of the woofer speaker, and together with the housing forms the rear sound cavity of the woofer speaker through the first sealing pad. The cavity of the woofer speaker provided by the invention and the installation ter-
(Continued)

minal applying the woofer speaker resolve the rear cover vibration problem of ultra-thin woofer speakers.

13 Claims, 3 Drawing Sheets

(51) Int. Cl.
*H04R 1/32* (2006.01)
*H04R 1/28* (2006.01)

(52) U.S. Cl.
CPC .. *H04R 2201/021* (2013.01); *H04R 2201/029* (2013.01); *H04R 2499/15* (2013.01)

(56) References Cited

U.S. PATENT DOCUMENTS 7,341,259 B1* 3/2008 Slabich ..... H04R 1/025 181/199
2004/0037445 A1* 2/2004 Kirihara ..... B60R 11/0217 381/389
2004/0050617 A1* 3/2004 Combest ..... H04R 1/02 181/199
2004/0258269 A1* 12/2004 Halsall ..... H04R 1/025 381/387
2006/0067557 A1* 3/2006 Imamura ..... H04R 1/025 381/388
2010/0150390 A1* 6/2010 Nishiyama ..... H04R 1/028 381/388
2012/0128197 A1* 5/2012 Li ..... H04R 1/2896 381/395
2013/0016863 A1* 1/2013 Liu ..... H04N 5/642 381/333
2014/0270304 A1* 9/2014 Pieklik ..... H04R 1/023 381/334
2014/0294217 A1* 10/2014 Yamaguchi ..... H04M 1/035 381/334
2016/0073201 A1* 3/2016 Jiang ..... H04R 1/22 381/394
2016/0080869 A1* 3/2016 Jiang ..... H04R 7/02 381/394
2016/0127835 A1* 5/2016 Jiang ..... H04R 9/045 381/398
2016/0165327 A1* 6/2016 Crosby ..... H04R 1/2811 381/332

FOREIGN PATENT DOCUMENTS

CN 103108268 A 5/2013
CN 203352782 U 12/2013
JP S54-76131 A 6/1979

OTHER PUBLICATIONS

International Search Report for PCT/CN2013/076600 filed on May 31, 2013.
Chinese Office Action for Application No. 201310207754.X, dated Jun. 30, 2015.

* cited by examiner

WOOFER SPEAKER AND THE REAR SOUND CAVITY FORMING METHOD THEREOF

The present invention is a U.S. National Stage of PCT/CN2013/076600, filed May 31, 2013, which claims the priority of Chinese patent application No. 201310207754.X filed on May 29, 2013, which are incorporated herein by reference.

TECHNICAL FIELD

The present invention relates to the acoustic-electric technical field, and more particularly, to a woofer speaker and a method for forming a rear acoustic cavity thereof.

BACKGROUND

With social progress and technology development, in recent years, televisions and other electronic products become increasingly thin. The requirements of users for the performance of these electronic products are higher and higher. Thus, the electronic parts mating with the electronic products are required to be smaller in size and thickness and improve in performance and consistency.

The woofer speaker is a kind of important electronic component which is widely used in the above mentioned electronic products. In thin-type electric devices such as liquid crystal TVs, laptop computers, etc., it is required to minimize the thickness of woofer speaker on the basis of guaranteeing the performance of the woofer speaker, so as to meet the needs of the thin-type electronic devices.

An ultra-thin woofer speaker works under a high power condition, and the pressure inside the cavity is very high. Since the rear cover is a plate having a large area, it is easy to vibrate and emit sound to the outside, and the phase of the rear cover is contrary to that of the speaker, thus resulting in that the systematic performance of the whole speaker becomes degraded.

Based on the above factors, there is a need to improve the installation mode of the traditional speaker and the installation terminal.

SUMMARY

In view of the above mentioned problems, an object of the present invention is to provide a woofer speaker and a method for forming the rear acoustic cavity thereof, so as to resolve the vibration problem of rear cover of the ultra-thin woofer speakers.

The present invention provides a woofer speaker, comprising a woofer speaker unit, a first sealing pad, a second sealing pad and a housing, wherein, the first sealing pad is hermetically coupled to the outer edge of the housing;

the woofer speaker unit is fixed and sealed within the housing by the first sealing pad, and the second sealing pad is located between the woofer speaker unit and the housing;

a sound hole is provided on the housing at the position where the woofer speaker is fixed, and the sound hole has a shape and a size corresponding to those of the woofer speaker; and a terminal installation plane on which the woofer speaker is fixed and mounted is a rear cover of the woofer speaker, and the terminal installation plane together with the housing defines a rear acoustic cavity of the woofer speaker by using the first sealing pad.

Moreover, a preferred scheme is that, the housing is fixedly connected with the terminal installation plane by screws or supporting members.

Moreover, a preferred scheme is that, the supporting members are provided at the two sides of the sound hole on the housing.

Moreover, a preferred scheme is that, the supporting member comprises two flat plates parallel to each other and two short plates fixedly connected between the two flat plates, and the two flat plates are unequal in length.

Moreover, a preferred scheme is that, the two short plates together with a shorter one among the two flat plates form a triangular prism structure.

Moreover, a preferred scheme is that, a mesh mask is provided on the sound hole of the housing.

Moreover, a preferred scheme is that, the woofer speaker unit comprises a vibrating diaphragm, at least two drive units independent of each other, a mounting plane and an annular side wall provided around the mounting plane;

the vibrating diaphragm comprises a dome portion located at central position and a suspension ring portion located at the periphery thereof; the driving unit comprises a voice coil unit and a magnetic circuit unit corresponding to the voice coil unit; and the voice coil unit is fixedly bonded to the dome portion of the vibrating diaphragm;

mounting holes for accommodating and fixing the magnetic circuit units, and sound outputting holes penetrating through the mounting plane are arranged on the mounting plane, and the upper side surface of the annular side wall is fixedly connected with the suspension ring portion of the vibrating diaphragm, wherein the number and positions of the mounting holes correspond to the number and positions of the voice coil units bonded to the dome portion of the vibrating diaphragm.

Moreover, a preferred scheme is that, the woofer speaker unit comprises the vibrating diaphragm and four or six driving units independent of each other;

the vibrating diaphragm comprises a dome portion located at central position and a suspension ring portion located at the periphery thereof;

the driving unit comprises a voice coil unit and a magnetic circuit unit corresponding to the voice coil unit; and four voice coil units are bonded to four corners of the dome portion of the vibrating diaphragm, respectively.

The present invention provides a method for forming a rear acoustic cavity of a woofer speaker, comprising:

fixing a woofer speaker unit inside a housing by using a sealing pad; and fixing the housing with a terminal installation plane which acts as the rear cover of the woofer speaker and together with the housing defines a rear acoustic cavity of the woofer speaker, wherein, a sound hole is provided on the housing at the position where the woofer speaker unit is fixed, and the sound hole has a shape and a size corresponding to those of the woofer speaker.

Moreover, a preferred scheme is that, the housing is fixedly connected with the terminal installation plane by screws or supporting members.

Moreover, a preferred scheme is that, the supporting member comprises two flat plates parallel to each other and two short plates fixedly connected between the two flat plates, and the two flat plates are unequal in length.

Moreover, a preferred scheme is that, the terminal installation plane is a wall surface, a desktop or a flat panel TV.

Moreover, a preferred scheme is that, a mesh mask is provided on the sound hole of the housing.

It can be known from the above technical schemes that, in the woofer speaker and the method for forming rear acoustic cavity thereof according to the present invention, the terminal installation plane acts as a part of the woofer speaker cavity; the terminal installation plane together with the housing defines the rear acoustic cavity of the woofer speaker; it can enhance strength compared to that case in which the woofer speaker individually uses the rear cover, and avoid that there emerges a problem that the rear cover vibrates and sound is emitted to the outside; in addition, it can further save the rear cover part of the woofer speaker cavity and reduce the cost.

In order to achieve the above mentioned and related objects, one or more aspects of the present invention comprise features which will be detailed hereinafter and will be pointed out in the claims. The following description and drawings describe in detail some exemplary aspects of the present invention. However, what these aspects indicate are only some modes of various modes that can use the principle of the present invention. Moreover, the present invention aims at comprising all such aspects and their equivalents.

BRIEF DESCRIPTION OF THE DRAWINGS

With reference to the description in conjunction with drawings and the contents of claims, and along with more complete understanding for the present invention, the other objects and results of the present invention will be more apparent and easy to understand. In the drawings.

Figure 1:
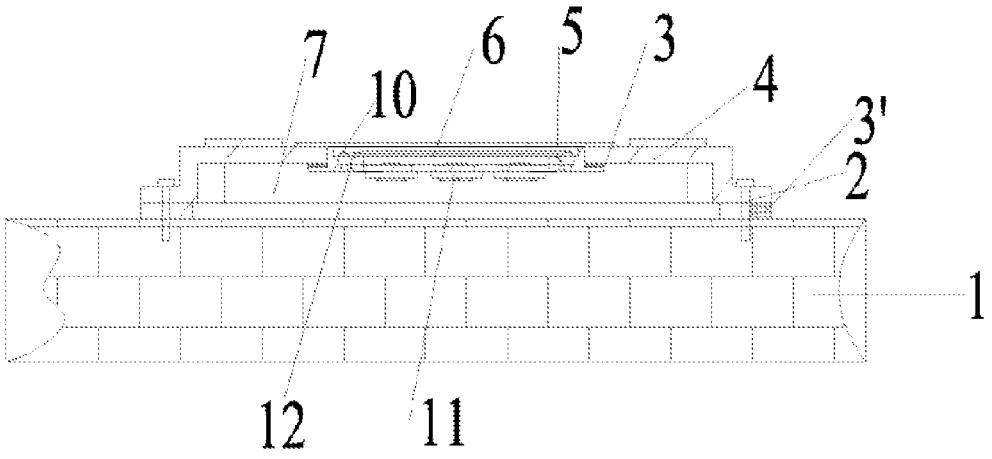
FIG. 1 is a cross-sectional view of a woofer speaker according to an embodiment of the present invention.

The reference numerals therein comprise: terminal installation plane 1, screw 2, second sealing pad 3, first sealing pad 3', housing 4, mesh mask 5, woofer speaker unit 6, rear acoustic cavity 7, supporting member 8, acoustic cavity 9 of woofer speaker, flat plate A, flat plate B, short plate C, short plate D, vibrating diaphragm 10, driving unit 11, FPCB connector 12.

Similar reference numerals in all figures indicate similar or corresponding features or functions.

DETAILED DESCRIPTION

Various specific details are set forth in the following description to provide comprehensive understanding of one or more embodiments for sake of illustration. However, it is obvious that these embodiments may be implemented without these specific details. The specific embodiments of the present invention will be detailed hereinafter in conjunction with the drawings.

FIG. 1 is a cross-sectional view of a woofer speaker according to an embodiment of the present invention.

As shown in FIG. 1, the woofer speaker provided by the present invention comprises a woofer speaker unit 6, a housing 4 for fixing the woofer speaker unit, a acoustic cavity formed by the woofer speaker unit 6 and the housing 4 (not shown in FIG. 1), a first sealing pad 3', a second sealing pad 3 and a terminal installation plane 1.

Therein, the terminal installation plane 1 fixedly mounted with the woofer speaker is the rear cover of the woofer speaker, the terminal installation plane 1 together with the housing 4 defines a rear acoustic cavity of the woofer speaker by using the first sealing pad 3'. That is, the acoustic cavity of the woofer speaker and the terminal installation plane 1 constitute a rear acoustic cavity 7, and the terminal installation plane 1 acts as the rear cover of the woofer speaker. The woofer speaker works under a high power condition, the pressure inside the acoustic cavity is very high, the terminal installation plane 1 acts as the rear cover of the woofer speaker, and is not easy to vibrate and emit sound to the outside, thus ensuring the systematic performance of the overall speaker does not change due to high power vibration. The second sealing pad 3 is arranged between the woofer speaker unit 6 and the housing 4. That is, the woofer speaker unit 6 and the housing 4 are hermetically combined with each other by using the second sealing pad 3, so as to avoid that sounds are emitted to the outside of the woofer speaker through the gap between the housing 4 and the woofer speaker unit 6.

The first sealing pad 3' and the outer edge of the housing 4 are hermetically combined with each other, and the woofer speaker unit 6 is fixedly sealed in the housing 4 by the first sealing pad 3'. That is, the woofer speaker unit 6 and the terminal installation plane 1 are hermetically combined with each other by using the first sealing pad 3', and the purpose of adopting the second sealing pad 3' is to be able to completely seal the gap between the woofer speaker unit 6 and the terminal installation plane 1 so as to prevent sound from emitting to the outside.

A mesh mask 5 is provided on the sound hole of the housing, and the mesh mask 5 is used for preventing dust so as to prevent dust from entering into the woofer speaker unit 6 to protect the woofer speaker unit 6 to work normally.

A sound hole is provided on the housing 4 at the position where the woofer speaker is fixed, and the sound hole has a shape and a size corresponding to those of the woofer speaker.

In the present invention, the woofer speaker unit 6 fixedly bonded to the housing 4, the housing 4 is fixedly connected with the terminal installation plane 1 of the woofer speaker; preferably, the housing 4 is fixedly connected with the terminal installation plane 1 of the woofer speaker through screws 2 or supporting members.

The installation terminal of the woofer speaker comprises a wall surface, a desktop and a flat panel TV, etc. The wall surface and the desktop are rigid planes. In the embodiment shown in FIG. 1, the terminal installation plane 1 is a wall surface or a rigid plane.

In the present invention, the woofer speaker unit comprises a vibrating diaphragm and at least two drive units independent of each other. In the embodiment shown in FIG. 1, the woofer speaker unit 6 comprises a vibrating diaphragm 10 and six drive units 11 independent of each other. The vibrating diaphragm 10 comprises a dome portion located at central position and a suspension ring portion located at the periphery thereof. The driving unit 11 comprises a voice coil unit and a magnetic circuit unit corresponding to the voice coil unit. The voice coil unit is fixedly bonded to the dome portion of the vibrating diaphragm 10.

The woofer speaker unit comprises a vibrating diaphragm and four or six drive units independent of each other; the driving unit comprises a voice coil unit and a magnetic circuit unit corresponding to the voice coil unit; if the woofer speaker comprises four driving units, the four voice coil units in the four driving units can be arranged at the four corners of the dome portion of the vibrating diaphragm, respectively; if the woofer speaker comprises six driving units, the voice coil units of the driving units can be arranged evenly at the surrounding positions of the dome portion of the vibrating diaphragm, or can be arranged on the dome portion in a decentralized irregular arranging way, so that resonance is avoided and driving forces are uniform.

The woofer speaker unit 6 further comprises a mounting plane and an annular side wall around the mounting plane. Mounting holes for accommodating and fixing the magnetic circuit units, and sound outputting holes penetrating through the mounting plane are arranged on the mounting plane, and the upper side surface of the annular side wall is fixedly connected with the suspension ring portion of the vibrating diaphragm, wherein the number and positions of the mounting holes correspond to the number and positions of the voice coil units bonded to the dome portion of the vibrating diaphragm.

The voice coil unit is electrically connected with external circuits through FPCB connectors 12. That is, the FPCB connectors 12 are used for electrically connecting the internal circuit of the woofer speaker and external circuit. Since the central part of the FPCB connector 12 is attached to a side of the vibrating diaphragm 10 where the voice coil is arranged, the central part of the FPCB connector 12 is positioned at a side of the mounting plane closer to the vibrating diaphragm 10, and the two terminals of the FPCB connector 12 extend from the sound outputting hole to a side of the mounting plane away from the vibrating diaphragm 10.

A plurality of mutually independent driving units can make driving forces uniform, generate greater driving forces, can act on higher power electrical devices or be fixed on such a structure as a wall surface and a desktop, etc. through screws.

Due to the reason of cost and the reason that the vibrating diaphragm needs to vibrate uniformly, the woofer speaker unit applied generally comprises four or six driving units.

In the present invention, the installation terminal of the woofer speaker comprises a wall surface, a desktop and the back plane of a flat panel TV, the above mentioned installation terminal is a wall surface or a rigid plane, and the terminal described below is a flat panel TV.

FIG. 2, FIG. 3, FIG. 4 and FIG. 5 are a schematic view of an installation structure, an installation top view, an installation cross-sectional view and an installation side view of a woofer speaker applying terminal according to another embodiment of the present invention, respectively.

As shown in FIG. 2, FIG. 3, FIG. 4 and FIG. 5, the woofer speaker provided by the present invention comprises the woofer speaker unit 6, the mesh mask 5, a acoustic cavity 9 of the woofer speaker formed by the woofer speaker unit 6 and the housing, the second sealing pad 3 and the first sealing pad 3', and supporting members 8 connected with the flat panel TV.

Figure 2:
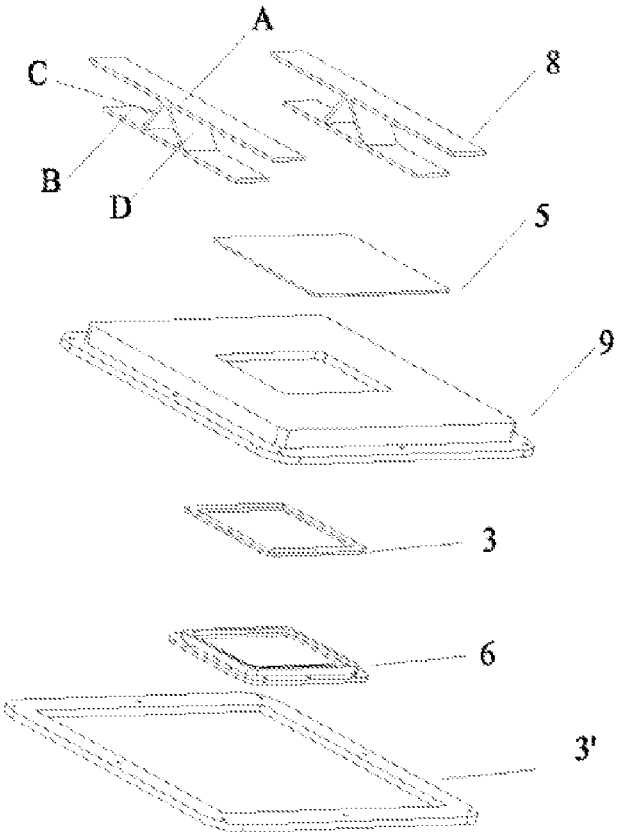
FIG. 2 is a schematic view showing installation structure of a woofer speaker applying terminal according to another embodiment of the present invention.

The supporting member 8 connected with the flat panel TV shown in FIG. 2 is composed of two flat plates A and B parallel to each other and a short plate C and a short plate D fixedly connected between the two flat plates A and B. The length of the flat plate A is greater than the length of the flat plate B, and the flat plate B, the short plate C and the short plate D are connected to constitute a triangular prism. Since a triangle has stability, the connection of the triangular prism structure is relatively steady.

Figure 3:
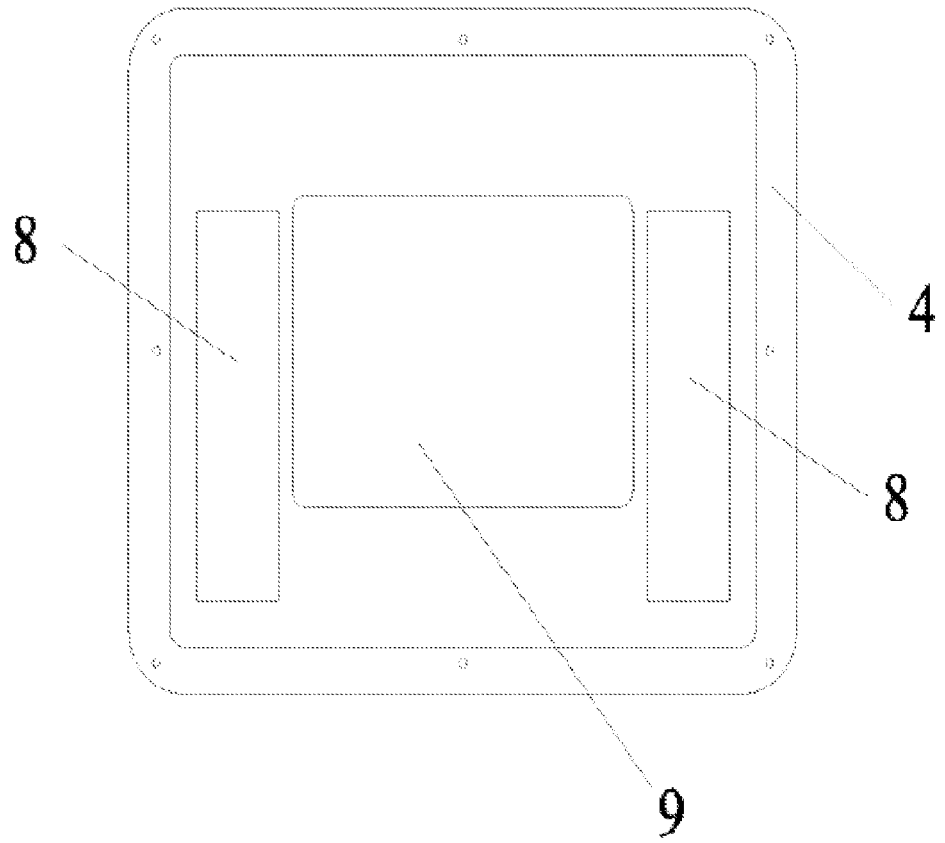
FIG. 3 is an installation top view of a woofer speaker applying terminal according to another embodiment of the present invention.
Figure 5:
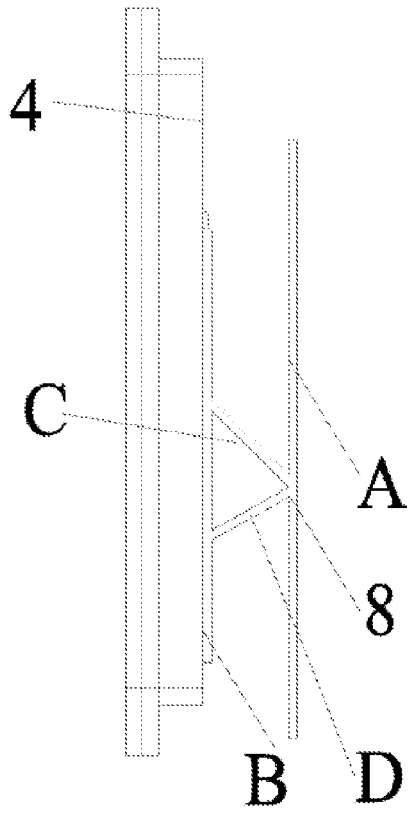
FIG. 5 is an installation side view of a woofer speaker applying terminal according to another embodiment of the present invention.

As shown in FIG. 5, the flat plate B of the supporting member 8 is connected with the housing 4, the flat plate A of the supporting member 8 is connected with the flat panel TV. As shown in FIG. 3, two supporting members 8 are mounted on the woofer speaker 6, and the supporting members 8 are arranged on the housing 4 at two sides of the sound hole, that is, the two supporting members 8 are provided at two sides of the acoustic cavity 9 of the woofer speaker, and the two supporting members 8 are connected with the flat panel TV, thus the acoustic cavity 9 of the woofer speaker and the flat panel TV constituting a rear acoustic cavity 7, that is, the flat panel TV together with the housing defines the rear acoustic cavity of the woofer speaker by using the first sealing pad. The flat panel TV acts as the rear cover of the woofer speaker, which increases the strength of the rear cover, and will not have a problem that the rear cover vibrates. The flat panel TV acts as the rear cover of the woofer speaker, and is not easy to vibrate and to emit sounds to the outside, thus ensuring the systematic performance of the whole speaker will not change due to high power vibration, even if the woofer speaker operates under a high power condition.

By using the flat panel TV as the rear cover of the woofer speaker, the part of the rear cover of the acoustic cavity of the woofer speaker 6 can also be omitted, thus being able to reduce cost.

The woofer speaker unit 6 is hermetically combined with the housing 4 and the flat panel TV by using the second sealing pad 3 and the first sealing pad 3', respectively, so as to prevent sounds from emitting to the outside of the woofer speaker 6 through a gap between the housing 4 and the woofer speaker 6; the purpose of using the sealing pad 3' is to completely seal the gap between the woofer speaker and the flat panel TV, thus preventing sounds from emitting to the outside.

Figure 4:
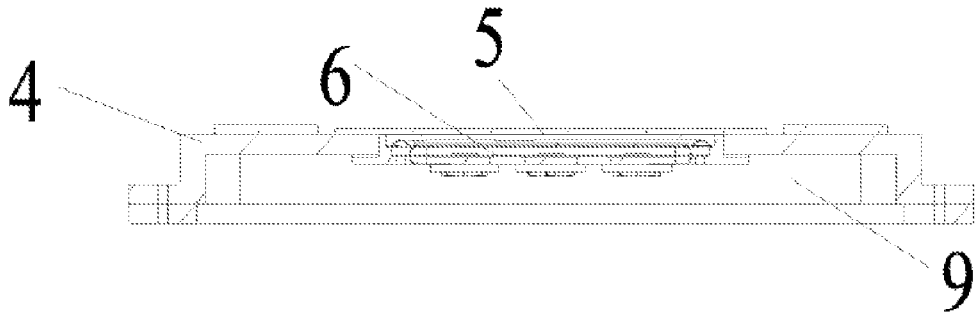
FIG. 4 is an installation cross-sectional view of a woofer speaker applying terminal according to another embodiment of the present invention.

As shown in FIG. 4, the woofer speaker unit 6 and the housing 4 form the acoustic cavity 9 of the woofer speaker. In order to increase the equivalent volume of the acoustic cavity 9 of the woofer speaker, sound absorbing material or gas adsorbing material can be provided in the acoustic cavity, so as to enhance the low frequency effect of the speaker as far as possible in a limited space range; in the meantime, the acoustic cavity 9 of the woofer speaker together with the TV defines a rear acoustic cavity; the combination of these two ways can better ensure the systematic performance of the whole speaker, and will not have the problem that the rear cover vibrates.

Wherein, a mesh mask 5 is provided on the sound hole of the housing, and the mesh mask 5 is used for preventing dust and protecting the woofer speaker unit 6.

In the embodiment shown in FIG. 4, the woofer speaker unit 6 comprises six driving units independent of each other; the six driving units can improve the sensitivity of the speaker, drive the vibrating diaphragm of the woofer speaker uniformly, make driving forces uniform, generate greater driving forces, and can act on higher power televisions as well as make the woofer speaker lighter and thinner.

Figure 6:
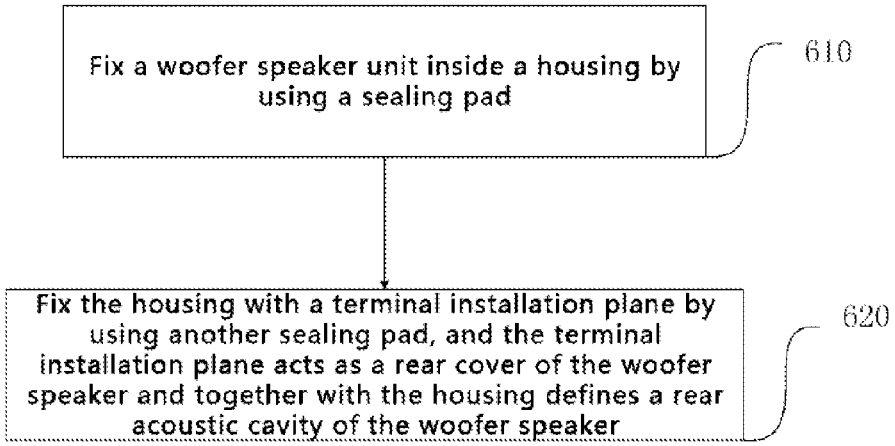
FIG. 6 is a flowchart showing the method for forming a rear acoustic cavity of a woofer speaker according to another embodiment of the present invention.

Based on the above mentioned woofer speaker, the present invention provides a method for forming a rear acoustic cavity of the woofer speaker, as shown in FIG. 6. FIG. 6 is a flowchart showing a method for forming a rear acoustic cavity of a woofer speaker according to an embodiment of the present invention. The specific process is as follows:

S610: Fixing a woofer speaker unit in a housing by using a sealing pad;

S620: Fixing the housing with a terminal installation plane by using another sealing pad, and the terminal installation plane acts as the rear cover of the woofer speaker and together with the housing defines the rear acoustic cavity of the woofer speaker, wherein, a sound hole is provided on the housing at the position where the woofer speaker unit is fixed, and the sound hole has a shape and a size corresponding to those of the woofer speaker.

In the step S620 of the above mentioned method for forming the rear acoustic cavity of the woofer speaker, the housing is fixedly connected with the terminal installation plane by screws or supporting members, the terminal installation plane is a wall surface, a desktop or a flat panel TV. In the step S620 of the above mentioned method, the terminal installation plane is a flat panel TV, the housing is connected with the flat panel TV through supporting members, the supporting member comprises two flat plates parallel to each other and two short plates fixedly connected between the two flat plates, and the two flat plates are unequal in length. The two short plates and a shorter one among the two flat plates form a triangular prism structure. Since a triangle has stability, the connection of the triangular prism structure is relatively steady.

In the process of the above mentioned method, a mesh mask is provided on the sound hole of the housing. The mesh mask is used for preventing dust, and protecting the woofer speaker unit to work normally.

It can be seen from the above implementation mode that, in the woofer speaker and the method for forming the rear acoustic cavity thereof provided by the present invention, the terminal installation plane acts as a part of the cavity of the woofer speaker, and together with the cavity of the woofer speaker constitutes a rear acoustic cavity, thus, compared to the case in which the woofer speaker individually uses the rear cover, being able to increase strength, avoiding the vibration of the rear cover and preventing sounds from emitting to the outside, so as to ensure that the systematic performance of the whole woofer speaker will not degrade; and in the meantime, the installation terminal acts as a part of the cavity of the woofer speaker, which can further omit the rear cover of the cavity of the woofer speaker, thus reducing cost.

As above, the woofer speaker and the method for forming the rear acoustic cavity thereof proposed according to the present invention are described by way of illustration with reference to the drawings. However, those skilled in the art should understand that, various improvements can be made to the woofer speaker and the method for forming the rear acoustic cavity thereof provided in the present invention, without departing from the contents of the present invention. Therefore, the protection scope of the present invention should be determined by the contents of the appended claims.

The invention claimed is:

1. A woofer speaker, comprising a woofer speaker unit, a first sealing pad, a second sealing pad and a housing, wherein, the first sealing pad is hermetically coupled to an outer edge of the housing;

the woofer speaker unit is fixed and sealed within the housing by the first sealing pad, and the second sealing pad is located between the woofer speaker unit and the housing;

a sound hole is provided on the housing at a position where the woofer speaker is fixed, and the sound hole has a shape and a size corresponding to those of the woofer speaker; and a terminal installation plane on which the woofer speaker is fixed and mounted is a rear cover of the woofer speaker, and the terminal installation plane together with the housing defines a rear acoustic cavity of the woofer speaker through the first sealing pad, wherein the housing is fixedly connected with the terminal installation plane by screws or supporting members.

2. The woofer speaker of claim 1, wherein, the supporting members are provided at the two sides of the sound hole on the housing.

3. The woofer speaker of claim 2, wherein, the supporting member comprises two flat plates parallel to each other and two short plates fixedly connected between the two flat plates, and the two flat plates are unequal in length.

4. The woofer speaker of claim 3, wherein, the two short plates together with a shorter one among the two flat plates form a triangular prism structure.

5. The woofer speaker of claim 1, wherein, a mesh mask is provided on the sound hole of the housing.

6. The woofer speaker of claim 1, wherein, the woofer speaker unit comprises a vibrating diaphragm, at least two drive units independent of each other, a mounting plane and an annular side wall provided around the mounting plane;

the vibrating diaphragm comprises a dome portion located at a central position and a suspension ring portion located at a periphery thereof;

each of the drive units respectively comprises a voice coil unit and a magnetic circuit unit corresponding to the voice coil unit; and the voice coil unit is fixedly bonded to the dome portion of the vibrating diaphragm;

mounting holes for accommodating and fixing the magnetic circuit units, and sound outputting holes penetrating through the mounting plane are arranged on the mounting plane, and the upper side surface of the annular side wall is fixedly connected with the suspension ring portion of the vibrating diaphragm; wherein, the number and positions of the mounting holes correspond to the number and positions of the voice coil units bonded to the dome portion of the vibrating diaphragm.

7. The woofer speaker of claim 1, wherein, the woofer speaker unit comprises a vibrating diaphragm and four or six drive units independent of each other;

the vibrating diaphragm comprises a dome portion located at a central position and a suspension ring portion located at a periphery thereof; and each of the drive units respectively comprises a voice coil unit and a magnetic circuit unit corresponding to the voice coil unit; and four of the voice coil units are bonded to four corners of the dome portion of the vibrating diaphragm, respectively.

8. A method for forming a rear acoustic cavity of a woofer speaker, comprising:

fixing a woofer speaker unit inside a housing by using a first sealing pad; and fixing the housing with a terminal installation plane by using a second sealing pad, and the terminal installation plane acts as a rear cover of the woofer speaker and together with the housing defines a rear acoustic cavity of the woofer speaker, wherein, a sound hole is provided on the housing at a position where the woofer speaker unit is fixed, and the sound hole has a shape and a size corresponding to those of the woofer speaker, and the housing is fixedly connected with the terminal installation plane by screws or supporting members.

9. The method of claim 8, wherein, the supporting member comprises two flat plates parallel to each other and two short plates fixedly connected between the two flat plates, and the two flat plates are unequal in length.

10. The method of claim 8, wherein, the terminal installation plane is a wall surface, a desktop or a flat panel TV.

11. The method of claim 8, wherein, a mesh mask is provided on the sound hole of the housing.

12. The method of claim 9, wherein, a mesh mask is provided on the sound hole of the housing.

13. The method of claim 10, wherein, a mesh mask is provided on the sound hole of the housing.

* * * * *